US005316071A

United States Patent [19]

Skinner et al.

[11] Patent Number: 5,316,071

[45] Date of Patent: May 31, 1994

[54] MOLTEN METAL DISTRIBUTION LAUNDER

[75] Inventors: Andrew C. Skinner, Spokane, Wash.; James A. Imthurn, Post Falls, Id.

[73] Assignee: Wagstaff Inc., Spokane, Wash.

[21] Appl. No.: 62,415

[22] Filed: May 13, 1993

[51] Int. Cl.[5] ..... B22D 41/02

[52] U.S. Cl. ..... 164/155.1; 266/236; 266/196; 164/437; 164/335

[58] Field of Search ..... 164/335, 437, 488, 449, 164/453; 222/591, 592; 266/280, 285, 236, 196

[56] References Cited

U.S. PATENT DOCUMENTS

| | | | |
|---|---|---|---|
| 4,498,521 | 2/1985 | Takeda et al. | 164/453 |
| 4,531,717 | 7/1985 | Hebrant | 266/236 |
| 4,567,935 | 2/1986 | Takeda et al. | 164/453 |
| 5,031,882 | 7/1991 | van Laar et al. | 266/196 |
| 5,129,631 | 7/1992 | van Laar | 266/285 |

FOREIGN PATENT DOCUMENTS

| | | | |
|---|---|---|---|
| 0204054 | 11/1983 | Fed. Rep. of Germany | 164/437 |
| 7410250 | 2/1975 | Netherlands | 164/437 |
| 2104633 | 3/1983 | United Kingdom | 266/236 |

*Primary Examiner*—Paula A. Bradley
*Assistant Examiner*—Erik R. Puknys
*Attorney, Agent, or Firm*—Wells, St. John, Roberts, Gregory & Matkin

[57] ABSTRACT

A low-flexure molten metal distribution launder comprises an elongated structural beam which extends over a plurality of casting stations. A plurality of metal level sensors extend downward from the elongated structural beam to measure molten metal levels in underlying metal casting stations. A plurality of spaced U-shaped refractory hangers are supported within the structural beam to form a refractory channel. Refractory liners are received within the refractory hangers to form a molten metal trough within the structural beam. The hangers are spaced from each other and supported from the structural beam in such a way as to allow them to expand and contract relative to the structural beam without subjecting the structural beam to expansion and contraction. The walls of the refractory hangers are air-cooled to reduce heat transfer from the refractory hangers to the structural beam.

35 Claims, 5 Drawing Sheets

MOLTEN METAL DISTRIBUTION LAUNDER

TECHNICAL FIELD

This invention relates to molten metal launders.

BACKGROUND OF THE INVENTION

Conventional EM (electromagnetic) or DC (direct chill) aluminum casting typically involves controllably discharging molten aluminum to one or more continuous casting stations. Each casting station includes a concave bottom block and a surrounding mold. The mold can be either a DC mold or an EM mold. In either case, casting is performed by discharging aluminum onto the bottom block and by gradually lowering the bottom block while cooling the mold and the lower portions of aluminum.

Various factors are responsible for the quality of the resulting ingot. Casting procedures have become quite complex in order to ensure consistent quality from one casting to another. Generally, three variables must be closely monitored and controlled to achieve optimum results: molten metal level, drop rate, and cooling rate.

U.S. Pat. No. 4,498,521, to Takeda et al., describes a system for maintaining a constant level of molten metal in a plurality of vertically-oriented continuous or semi-continuous casting units. The Takeda system includes a float level sensor for precisely measuring the level or elevation of molten metal in a casting station during all portions of the casting process. The float level sensor is suspended from a molten metal launder over a casting station.

In conventional casting systems, a metal launder typically has a plurality of metal discharge spouts, and spans a like number of casting stations. It is generally impractical to provide external vertical support for the launder at any intermediate positions along its length. Rather, the launder is supported at both of its ends, and is designed with sufficient structural strength to support its own weight and the weight of any molten aluminum contained therein.

However, a metal level sensing system such as described by Takeda et al. requires not only that a launder be strong enough to support itself, but that it be strong enough to establish and maintain a stable measurement platform from which molten metal level measurements can be made. This is because all vertical measurements in the Takeda system are referenced from the launder beam, along its unsupported length over casting stations. Molten metal level is thus controlled and maintained relative to the elevation of the metal distribution launder. Any change in the elevation of the launder will cause a corresponding change in the level of molten aluminum within an underlying casting station. It is, therefore, extremely desirable to provide a metal distribution launder which resists movement or flexure in the vertical direction.

Vertical launder flexure results from two causes: variability in the amount and corresponding weight of contained molten aluminum, and vertical temperature gradients produced in structural parts of the metal distribution launder. Flexure from the first cause can be reduced by providing structural reinforcement along the length of the metal distribution launder. However, structural reinforcement is not effective against heat-induced launder flexure.

One cause of temperature gradients within a launder is radiant heat from underlying molten metal in casting stations. A more significant cause is heat transferred or conducted from molten metal contained within the launder itself. Since molten metal flows along the bottom of a distribution launder, resulting heat buildup in the structural members of the launder tends to be greater toward the bottom of the launder than toward the top of the launder. This causes the launder to bow. In some cases such bowing can be quite extreme, virtually eliminating any chance of accurately measuring the elevation of molten metal within underlying casting stations.

Previous attempts to eliminate launder bowing and flexing have involved structural reinforcements and launder cooling. However, these attempts have not yielded acceptable results. Structural reinforcement is generally ineffective against heat-induced flexure. Cooling has also been unsuccessful. Water cooling is especially undesirable because of the undesirable reactions which can occur between water and molten aluminum.

The invention described below greatly reduces or eliminates flexure in a metal distribution launder, so that accurate and repeatable measurements can be made from the launder of molten metal levels within an underlying casting station. This result is achieved without adding significantly to the cost or complexity of the launder.

BRIEF DESCRIPTION OF THE DRAWINGS

Preferred embodiments of the invention are described below with reference to the accompanying drawings.

DETAILED DESCRIPTION OF THE PREFERRED EMBODIMENT

Figure 1:
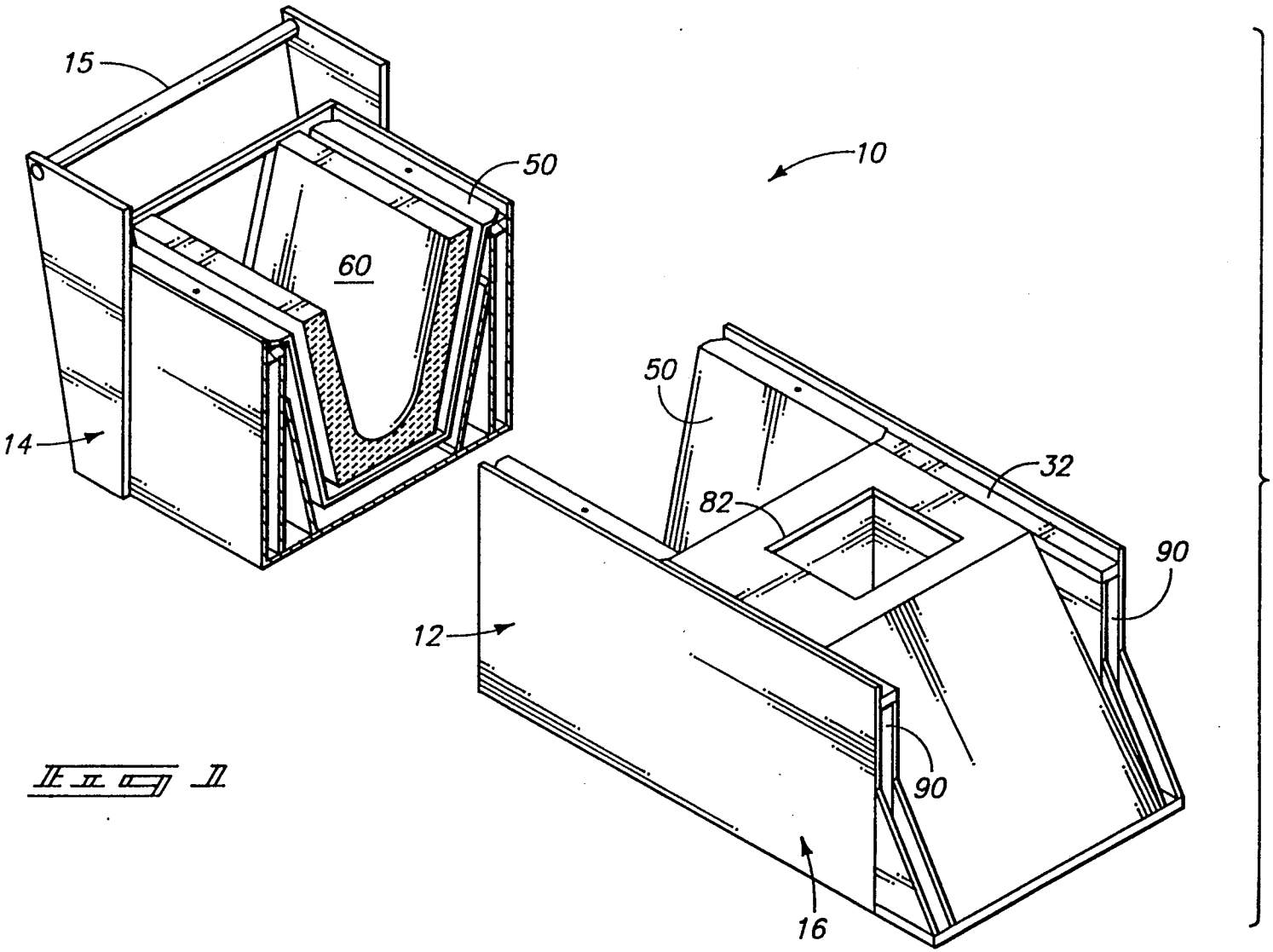
FIG. 1 is a perspective view of a molten metal launder in accordance with a preferred embodiment of the invention.

This disclosure of the invention is submitted in furtherance of the constitutional purposes of the U.S. Patent Laws "to promote the progress of science and useful arts." U.S. Constitution, Article 1, Section 8.

FIGS. 1–6 show a low-flexure metal distribution launder for containing molten materials and for distributing molten metal to a plurality of metal casting stations. The low-flexure launder is generally designated by the reference numeral 10.

Referring to FIG. 1, metal launder 10 includes an elongated structural beam 12 which extends longitudinally between an open end 14 and an opposite closed end 16. Beam 12 is referred to as "structural" to indicate its load-bearing function. Beam open end 14 has a transverse pivot pin 15 which is mounted to a fixed support (not shown). Pivot pin 15 provides a fixed longitudinal anchor at beam open end 14, while allowing metal launder 10 to be inclined for draining molten metal back toward open end 14 after casting is completed.

Figure 6:
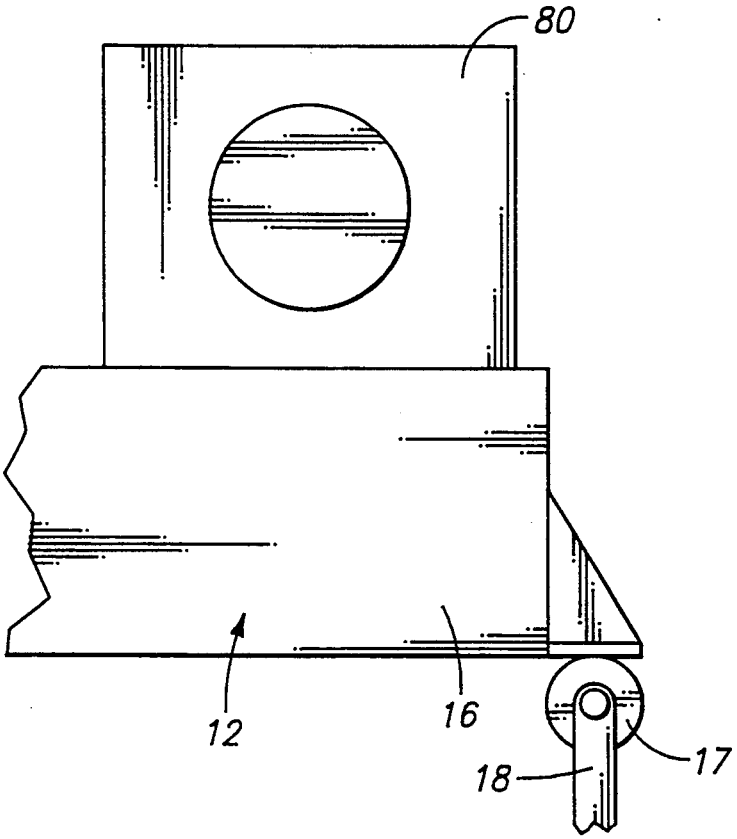
FIG. 6 is a side view of a closed end of the molten metal launder of FIG. 1.

Beam closed end 16 is supported as shown in FIG. 6 by a beam support 17. In the preferred embodiment shown, beam support 17 is a roller which is mounted to allow longitudinal movement of beam closed end 16. This accommodates expansion and contraction of the elongated structural beam, reducing or eliminating resulting longitudinal loading forces in beam 12. Beam support 17 is preferably supported by a powered piston 18 which is driven upward to incline beam 12 after completion of casting.

Beam 12 has an unsupported length or span between its ends 14 and 16 for spanning a plurality of metal casting stations. It must support its own weight over this span as well as the weight of significant amounts of molten metal. Furthermore, beam 12 must be relatively inflexible, so that it does not bend or bow appreciably along its length, in spite of variations in load.

Figure 2:
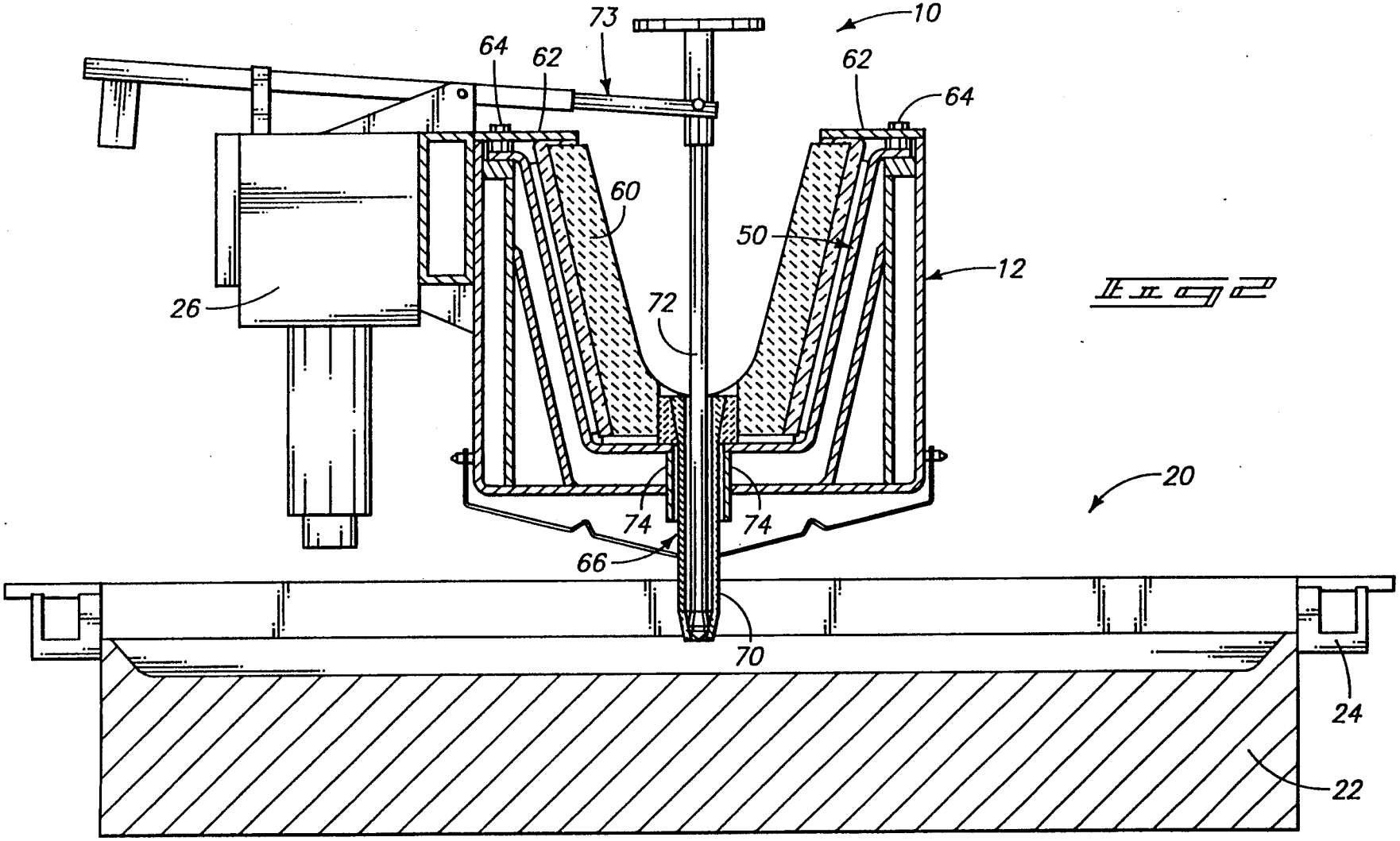
FIG. 2 is a cross-sectional view of the molten metal launder of FIG. 1 and of an underlying vertical casting station.

FIG. 2 shows an example of a DC (direct chill) metal casting station, generally designated by the reference numeral 20. Launder 10 can also be used in conjunction with EM (electromagnetic) casting, or in conjunction with any other process in which the elevation of a spanning molten metal launder must be maintained within close tolerances. The invention is particularly useful in conjunction with continuous or semicontinuous ingot casting systems that include a plurality of individual casting stations. The preferred distribution launder described herein spans five such individual casting stations, while being vertically supported only at its opposite ends. This corresponds to an unsupported length of approximately 24 feet.

Each DC metal casting station 20 comprises a bottom block 22 and a mold 24. Bottom block 22 is dropped at a carefully controlled rate during casting to form aluminum ingots of a desired length. Mold 24 includes water cooling means for cooling and solidifying aluminum as it is dropped through mold 24.

Launder 10 includes a plurality of metal level sensors, such as the single metal level sensor 26 shown, to measure molten metal levels in metal casting stations such as station 20. In general, one metal level sensor 26 extends downward from the unsupported length of elongated structural beam 12 above each casting station 20. Metal level sensor 26 can be any one of a number of available sensors, such as a float, an optical sensor, a capacitive sensor, or an inductive sensor. Since sensor 26 is mounted to structural beam 12, however, all measurements are referenced to the elevation of structural beam 12. Furthermore, the height of molten metal in casting station 20 is controlled relative to the sensor measurements. Therefore, any bending or flexure of structural beam 12 during casting causes a corresponding variation in the level of molten metal in casting station 20. Accordingly, it is desired to minimize launder beam flexing to maintain molten metal levels to close tolerances.

Figure 3:
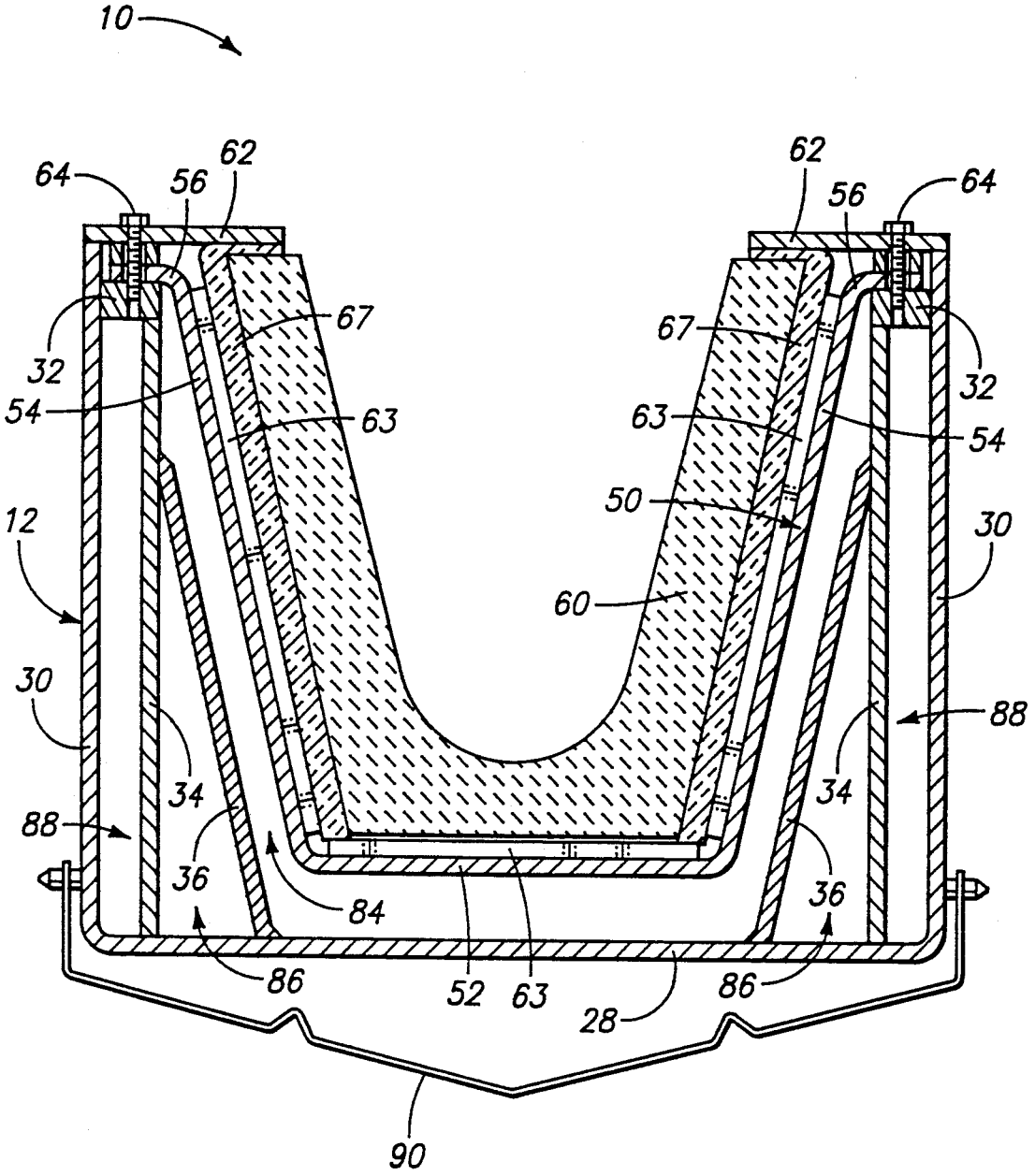
FIG. 3 is a cross-sectional view of the molten metal launder of FIG. 1.

An upwardly-open structural beam channel is formed along the unsupported length of structural beam 12 by a beam bottom wall 28 and triple beam sidewalls (FIG. 3). A pair of outer sidewalls 30 extend vertically upward from the sides of bottom wall 28. An opposed pair of support rails 32 extend longitudinally along the top inside edge of outer sidewalls 30. A pair of inner sidewalls 34 are spaced inwardly from outer sidewalls 30. Inner sidewalls 34 are positioned along the length of structural beam 12, extending downward from support rails 32 to bottom wall 28. A pair of gusset sidewalls 36 also extends along the length of structural beam 12. Gusset sidewalls 36 are inclined slightly outwardly from bottom to top, extending from bottom wall 28 to an intermediate point along inner sidewalls 34. In conjunction with bottom wall 28, gusset sidewalls 36 and inner sidewalls 34 form an internal U-shaped channel within structural beam 12. Inner sidewalls 34 and gusset sidewalls 36 also add strength to structural beam 12 while providing heat insulating functions as will be described below.

A plurality of spaced refractory holders or hangers 50 are aligned along structural beam 12, being received within the U-shaped channel of structural beam 12. Each holder 50 is approximately 21 inches in length, and is spaced from the adjacent holder by about ⅛ inch to form longitudinal expansion areas between the refractory holders. Holders 50 are U-shaped similarly to the shape of the internal channel within structural beam 12. However, holders 50 are spaced from the walls of structural beam 12. More specifically, each refractory holder 50 comprises a bottom wall 52 and longitudinally-extending sidewalls 54. Sidewalls 54 extend generally upwardly from the sides of bottom wall 52, at a slight outward angle. Bottom walls 52 of refractory holders 50 are vertically spaced from bottom wall 28 of structural beam 12. Sidewalls 54 of refractory holders 50 are horizontally spaced from gusset sidewalls 36 and inner sidewalls 34 of structural beam 12. This spacing forms a heat-insulating region or air space between the refractory holder walls and the elongated structural beam.

Figure 4:
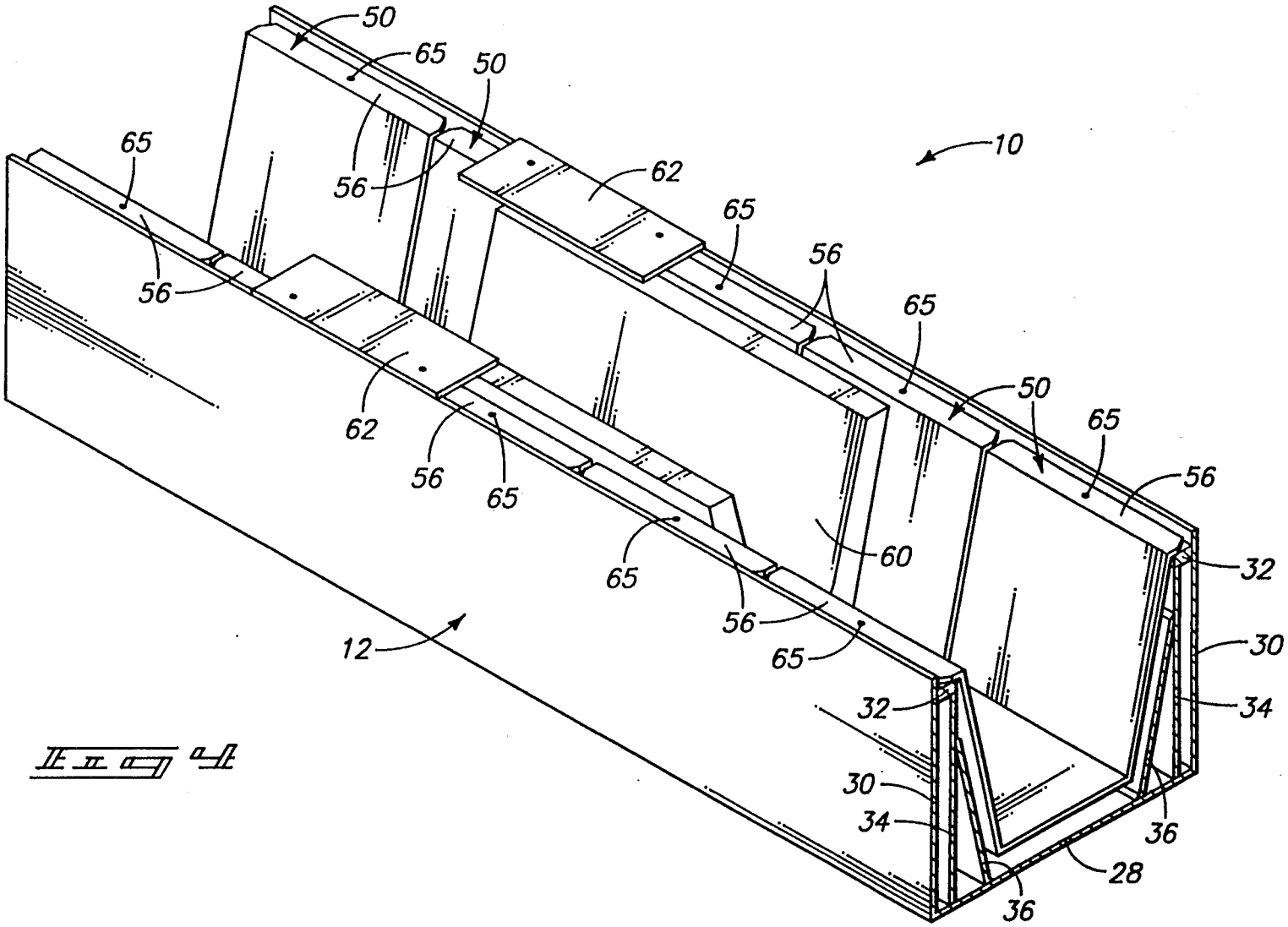
FIG. 4 is a perspective view of a section of the molten metal launder of FIG. 1, the launder being shown in a partially fabricated condition.
Figure 5:
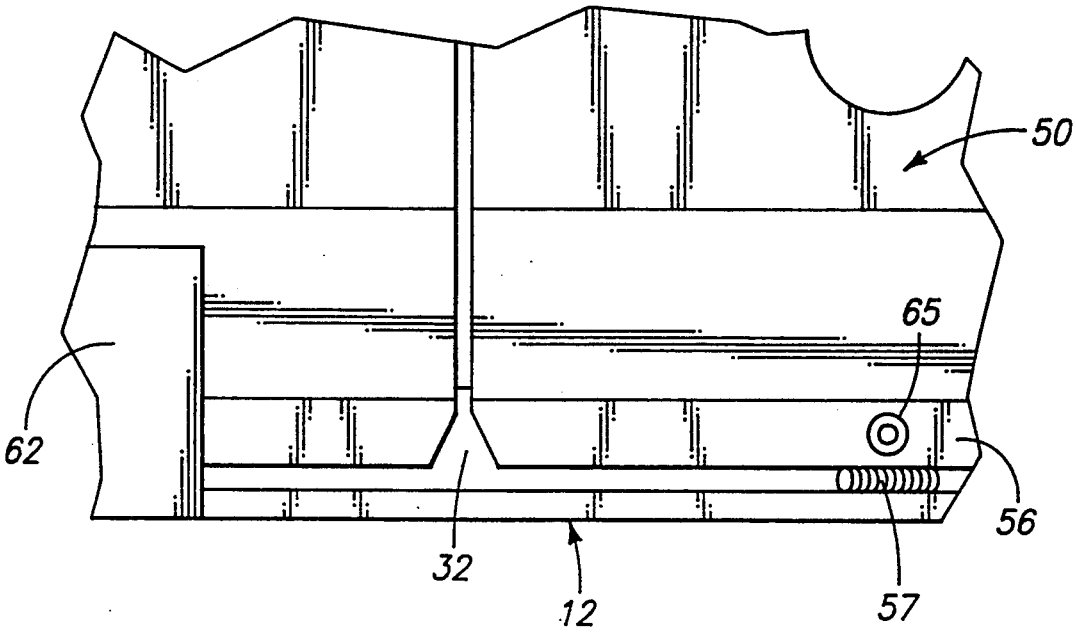
FIG. 5 is an enlarged top view of a portion of the molten metal launder of FIG. 1.

Refractory holders 50 have upper support lips 56 (FIG. 4) which extend outwardly from the tops of sidewalls 54. Support rails 32 form longitudinally-extending hanger support surfaces upon which upper support lips 56 are supported. As shown in FIG. 5, each holder 50 has a medial portion along its longitudinal length which is securely positioned relative to structural beam 12. Specifically, each holder 50 is welded at its longitudinal center to the underlying support rail 32 by a one inch long fillet weld 57 along the outer edge of the support lips 56. The remaining, distal longitudinal portions of each refractory holder 50 are not securely positioned relative to the structural beam. The distal portions of refractory holders 50 are thus free to move longitudinally relative to the structural beam 12. This, in conjunction with the spacing between holders 50, allows refractory holders 50 to longitudinally expand and contract relative to each other and to elongated structural channel 12.

Aligned refractory holders 50 have inner and outer surfaces. The inner surfaces of refractory holders 50 from a refractory channel within the unsupported length of structural beam 12. A plurality of refractory liners 60 are received within the inner surfaces of the refractory holders 50 to form a molten metal channel or trough along the unsupported length of structural beam 12 (FIG. 4). Each refractory liner 60 has a length which is sufficient to span at least one of the refractory holders 50. The length of each refractory liner 60 is preferably about twice that of an individual refractory holder 50, or about 42 inches. This is equal to the spacing of underlying casting stations 20. Refractory liners 60 have longitudinal ends which are positioned at central longitudinal positions within refractory holders 50. To accomplish this alignment, refractory holders 50 have first longitudinal lengths, and refractory liners 60 have second longitudinal lengths. The second longitudinal lengths are whole multiples of the first longitudinal lengths.

Refractory liners 60 are held clamped within refractory holders 50 by a plurality of peripheral mounting plates 62 positioned along the edges of structural beam 12. Each mounting plate 62 extends inwardly from the upper edge of a beam outer sidewall 30, to a position above a refractory liner 60. Two bolts 64 extend downward through mounting plate 62, through a clearance hole 65 in lip 56 of refractory holder 50, and into a threaded hole in support rail 32. Tightening bolts 64 brings mounting plate 62 to bear downwardly against refractory liner 60 to hold it within refractory holder 50. Conventional insulating materials such as insulating boards 63 and insulating blankets 67 are placed between refractory liners 60 and the underlying holders 50.

A plurality of downspouts 66 extend through refractory liners 60 from the molten metal trough to deliver molten metal from the molten metal trough into casting stations 20 (FIG. 2). A downspout 66 comprises, as shown in FIG. 2, a ceramic tube 70 which extends downward from within refractory liner 60 to an elevation within mold 24. A ceramic control pin or valve plug 72 controls the rate of molten metal flow through ceramic tube 70. Control pin 72 extends upwardly and is connected to an automatic flow control mechanism 73.

A spout sleeve 74 extends vertically through the heat-insulating region between bottom wall 28 of structural beam 12 and one of refractory holders 50. The spout sleeve is welded or otherwise attached to a medial longitudinal portion of refractory holder 50 to securely position said medial longitudinal portion of refractory holder 50 relative to elongated structural beam 12. More specifically, spout sleeve 74 is welded or otherwise attached about its periphery to the bottom walls of both refractory holder 50 and structural beam 12. This ensures that the position of downspout 66 will remain longitudinally fixed, regardless of expansion or contraction taking place in holders 50 or liners 60. Ceramic tube 70 is received within spout sleeve 74 to securely position ceramic tube 70 relative to structural beam 12.

Heat-induced flexing of launder 10 is reduced or eliminated by provision of refractory holders 50 in the unique structure described above. Refractory holders 50 are vertically supported by and within the structural beam to allow longitudinal expansion and contraction of the refractory holders relative to the structural beam. Liners 60 are supported on non-structural components so that any heat-induced expansion or contraction is absorbed relative to the structural members rather than by the structural members. Holders 50 are structurally isolated from structural beam 12 by affixing them to structural beam 12 at single longitudinal portions, and by spacing them from each other. The remaining longitudinal portions are allowed to move through expansion and contraction relative to structural beam 12. The heat from refractory liners 60 is insulated from structural beam 12 by the heat-insulating regions beneath and beside refractory holders 50.

To provide further heat isolation between holders 50 and structural beam 12, launder 10 includes an air blower 80 mounted to closed end 16 of structural beam 12 (FIG. 6). The walls of structural beam 12 and refractory holders 50 form a longitudinal air duct in and through the heat-insulating region between the refractory holder walls and the elongated structural beam, along the outer surfaces of refractory holders 50. Blower 80 is in fluid communication with the longitudinal air duct to circulate cooling air through the air duct along the outer surfaces of the refractory holder walls.

More specifically, closed end 16 of launder 10 has an aperture 82 to which blower 80 is connected. Aperture 82 communicates with a first cooling duct 84 (FIG. 3), formed between holder sidewalls 54 and gusset sidewalls 36, and a pair of second cooling ducts 86, formed between gusset sidewalls 36 and inner sidewalls 34. First cooling duct 84 preferably extends along the full vertical height of refractory holders 50 to minimize any temperature gradients between the top and bottom of refractory holders 50. Air blower 80 forces air through first and second cooling ducts 84 and 86, along the entire length of structural beam 12 from closed end 16 to open end 14. Blower 80 has a capacity of about 1500 cubic feet per minute.

A pair of third, outer cooling ducts 88 are formed between inner beam sidewalls 34 and outer beam sidewalls 30. Appropriate apertures in inner beam sidewalls 34 at the open end 14 of structural beam 12 allow cooling air to return through the third cooling ducts 88. Cooling air exits structural beam 12 through exit apertures 90 at closed end 16 of structural beam 12 (FIG. 1).

A foil liner (not shown) is positioned beneath the refractory holders 50 to prevent any air pressure in first cooling duct 84 from affecting the joints between adjacent refractory liners. This liner is made necessary by the gaps between refractory holders 50.

In addition, a polished stainless steel heat reflector 90 (FIG. 2) is mounted beneath structural beam 12 to protect structural beam 12 from heat radiating from underlying molten aluminum.

The cooling air carries away heat which is transferred from molten metal within refractory liners 60 to the outer surfaces of holders 50, minimizing the heat transferred to structural members of launder 10.

The various components described above are generally fabricated from metals such as steel or stainless steel, except as indicated.

In compliance with the statute, the invention has been described in language more or less specific as to structural features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A low-flexure launder for molten materials, comprising:

an elongated structural beam which extends longitudinally between opposite ends, the structural beam having an unsupported length between its ends;

a plurality of refractory holders extending along the structural beam, each refractory holder being vertically supported by the structural beam to allow longitudinal expansion and contraction of said refractory holder relative to the structural beam;

a refractory liner received by the refractory holders;

wherein the refractory holders have inner surfaces and outer surfaces, the refractory liner being received within the inner surfaces of the refractory holders, the outer surfaces of the refractory holders being spaced from the elongated structural beam to form an air space along the outer surfaces of the refractory holders.

2. A low-flexure launder as recited in claim 1, further comprising a beam support beneath one of the elongated structural beam's opposite ends, wherein the beam support allows longitudinal movement of said one of the opposite ends to accommodate expansion and contraction of the elongated structural beam.

3. A low-flexure launder as recited in claim 1, wherein the refractory holders are spaced from each other to form longitudinal expansion areas between the refractory holders, the expansion areas allowing longitudinal expansion and contraction of the refractory holders relative to the structural beam.

4. A low-flexure launder for molten materials, comprising:

an elongated structural beam which extends longitudinally between opposite ends, the structural beam having an unsupported length between its ends;

a plurality of refractory holders extending along the structural beam, each refractory holder being vertically supported by the structural beam to allow longitudinal expansion and contraction of said refractory holder relative to the structural beam;

a refractory liner received by the refractory holders;

wherein each refractory holder has a portion along its longitudinal length which is securely positioned relative to the structural beam, the remaining longitudinal portions of each refractory holder being free to move longitudinally relative to the structural beam.

5. A low-flexure launder as recited in claim 1, wherein each refractory holder has a medial portion along its longitudinal length which is securely positioned relative to the longitudinal beam, the remaining longitudinal portions of each refractory holder being free to move longitudinally relative to the structural beam.

6. A low-flexure launder for molten materials, comprising:

an elongated structural beam which extends longitudinally between opposite ends, the structural beam having an unsupported length between its ends;

a plurality of refractory holders extending along the structural beam, each refractory holder being vertically supported by the structural beam to allow longitudinal expansion and contraction of said refractory holder relative to the structural beam;

a refractory liner received by the refractory holders;

wherein each refractory holder is a U-shaped hanger having longitudinally-extending sidewalls and support lips extending outward from the sidewalls, the structural beam having longitudinally-extending hanger support surfaces upon which the hanger lips are supported.

7. A low-flexure launder as recited in claim 6, wherein the refractory holders have inner surfaces and outer surfaces, the refractory liner being received within the inner surfaces of the refractory holders, the outer surfaces of the refractory holders being spaced from the elongated structural beam to form a longitudinal air duct along the outer surfaces of the refractory holders.

8. A low-flexure launder as recited in claim 1, the low-flexure launder further comprising an air blower in fluid communication with the air space to circulate cooling air through the air space along the outer surfaces of the refractory holders.

9. A low-flexure molten metal distribution launder comprising:

an elongated structural channel which extends longitudinally between opposite ends, the elongated channel having an unsupported length between its ends;

a plurality of U-shaped refractory holders aligned along the elongated structural channel to form a refractory channel within the unsupported length of the elongated structural channel, each refractory holder being vertically supported within the elongated structural channel to allow longitudinal expansion and contraction of said refractory holder relative to the elongated structural channel, each refractory holder having walls which are spaced from the elongated structural channel to form an air space between the refractory holder walls and the elongated structural channel;

a plurality of refractory liners received within the refractory holders to form a molten metal trough along the unsupported length of the elongated structural channel; and a plurality of downspouts which extend through the refractory liners from the molten metal trough to deliver molten metal from the molten metal trough.

10. A low-flexure molten metal distribution launder as recited in claim 9, further comprising a beam support beneath one of the elongated structural channel's opposite ends, wherein the beam support allows longitudinal movement of said one of the opposite ends to accommodate expansion and contraction of the elongated structural channel.

11. A low-flexure molten metal distribution launder as recited in claim 9, wherein the refractory holders are spaced from each other to form longitudinal expansion areas between the refractory holders, the expansion areas allowing longitudinal expansion and contraction of the refractory holders relative to the elongated structural channel.

12. A low-flexure molten metal distribution launder as recited in claim 9, wherein each refractory holder has a medial portion along its longitudinal length which is securely positioned relative to the elongated structural channel, the remaining longitudinal portions of each refractory holder being free to move longitudinally relative to the elongated structural channel.

13. A low-flexure molten metal distribution launder as recited in claim 9, wherein each refractory holder has longitudinally-extending sidewalls and upper support lips extending outward from the sidewalls, the elongated structural channel having longitudinally-extending support surfaces upon which the support lips are supported.

14. A low-flexure molten metal distribution launder as recited in claim 9, a longitudinal air duct being formed through the air space between the holder walls and the elongated structural channel.

15. A low-flexure molten metal distribution launder as recited in claim 9, a longitudinal air duct being formed through the air space between the walls and the elongated structural channel, the low-flexure launder further comprising an air blower in fluid communication with the longitudinal air duct to circulate cooling air through the air duct along the walls of the refractory holders.

16. A low-flexure molten metal distribution launder as recited in claim 9, each downspout comprising:

a spout sleeve extending vertically through the air space between the elongated structural channel and one of the refractory holders, the spout sleeve being attached to a medial longitudinal portion of said one of the refractory holders to securely position said medial longitudinal portion of said one of the refractory holders relative to the elongated structural channel;

wherein said one of the refractory holders has distal longitudinal portions which are not securely positioned relative to the elongated structural channel, to allow said one of the refractory holders to longitudinally expand and contract relative to the elongated structural channel.

17. A low-flexure molten metal distribution launder as recited in claim 9, wherein the refractory holders have first longitudinal lengths and the refractory liners have second longitudinal lengths, the second longitudinal lengths being whole multiples of the first longitudinal lengths, wherein the refractory liners have longitudinal ends which are positioned at central longitudinal positions within the refractory holders.

18. A low-flexure molten metal distribution launder as recited in claim 9, wherein:

the refractory holders have first longitudinal lengths and the refractory liners have second longitudinal lengths, the second longitudinal lengths being whole multiples of the first longitudinal lengths, wherein the refractory liners have longitudinal ends which are positioned at central longitudinal portions of the refractory holders;

the low-flexure launder further comprises a spout sleeve extending vertically through the air space between the elongated structural channel and one of the refractory holders, the spout sleeve being attached to a medial longitudinal portion of said one of the refractory holders to securely position said medial longitudinal portion of said one of the refractory holders relative to the elongated structural channel;

wherein said one of the refractory holders has distal longitudinal portions which are not securely positioned relative to the elongated structural channel to allow said one of the refractory holders to longitudinally expand and contract relative to the elongated structural channel.

19. A low-flexure molten metal distribution launder for distributing molten metal to a plurality of metal casting stations, comprising:

an elongated structural channel which extends longitudinally between opposite ends, the elongated structural channel having an unsupported length for spanning metal casting stations;

a plurality of metal level sensors which extend downward from the unsupported length of the elongated structural channel to measure molten metal levels in metal casting stations;

a plurality of U-shaped refractory hangers received within the elongated structural channel to form a refractory channel along the unsupported length of the elongated structural channel, each refractory hanger having walls which are spaced from the elongated structural channel to form a heat-insulating region between the refractory hanger walls and the elongated structural channel, the refractory hangers being spaced from each other and being mounted within the elongated structural channel to allow longitudinal expansion and contraction of said refractory hangers relative to the elongated structural channel;

a plurality of refractory liners received within the refractory hangers to form a molten metal trough along the unsupported length of the elongated structural channel; and a plurality of downspouts which extend through the refractory liners from the molten metal trough to deliver molten metal from the molten metal trough into casting stations.

20. A low-flexure molten metal distribution launder as recited in claim 19, further comprising a beam support beneath one of the elongated structural channel's opposite ends, wherein the beam support allows longitudinal movement of said one of the opposite ends to accommodate expansion and contraction of the elongated structural channel.

21. A low-flexure molten metal distribution launder as recited in claim 19, wherein each refractory hanger has a medial portion along its longitudinal length which is securely positioned relative to the elongated structural channel, the remaining longitudinal portions of each refractory hanger being free to move longitudinally relative to the elongated structural channel.

22. A low-flexure molten metal distribution launder as recited in claim 19, wherein each refractory hanger has longitudinally-extending sidewalls and upper support lips extending outward from the sidewalls, the elongated structural channel having longitudinally-extending hanger support surfaces upon which the upper support lips are supported.

23. A low-flexure molten metal distribution launder as recited in claim 19, a longitudinal air duct being formed through the heat-insulating region between the hanger walls and the elongated structural channel.

24. A low-flexure molten metal distribution launder as recited in claim 19, a longitudinal air duct being formed through the heat-insulating region between the hanger walls and the elongated structural channel, the low-flexure metal distribution launder further comprising an air blower in fluid communication with the longitudinal air duct to circulate cooling air through the air duct along the walls of the refractory hangers.

25. A low-flexure molten metal distribution launder as recited in claim 19, each downspout comprising:

a spout sleeve extending vertically through the heat-insulating region between the elongated structural channel and one of the refractory hangers, the spout sleeve being attached to a medial longitudinal portion of said one of the refractory hangers to securely position said medial longitudinal portion of said one of the refractory hangers relative to the elongated structural channel;

wherein said one of the refractory hangers has distal longitudinal portions which are not securely positioned relative to the elongated structural channel to allow said one of the refractory hangers to longitudinally expand and contract relative to the elongated structural channel.

26. A low-flexure molten metal distribution launder as recited in claim 19, wherein the refractory hangers have first longitudinal lengths and the refractory liners have second longitudinal lengths, the second longitudinal lengths being whole multiples of the first longitudinal lengths, wherein the refractory liners have longitudinal ends which are positioned at central longitudinal positions within the refractory hangers.

27. A low-flexure molten metal distribution launder as recited in claim 19, wherein:

the refractory hangers have first longitudinal lengths and the refractory liners have second longitudinal lengths, the second longitudinal lengths being whole multiples of the first longitudinal lengths, wherein the refractory liners have longitudinal ends which are positioned at central longitudinal portions of the refractory hangers;

the low-flexure metal distribution launder further comprises a spout sleeve extending vertically through the heat-insulating region between the elongated structural channel and one of the refractory hangers, the spout sleeve being attached to a medial longitudinal portion of said one of the refractory hangers to securely position said medial longitudinal portion of said one of the refractory hangers relative to the elongated structural channel;

wherein said one of the refractory hangers has distal longitudinal portions which are not securely positioned relative to the elongated structural channel to allow said one of the refractory hangers to longitudinally expand and contract relative to the elongated structural channel.

28. A low-flexure molten metal distribution launder as recited in claim 19, wherein the refractory hangers have sidewalls and the heat insulating region extends vertically along their height, a longitudinal air duct being formed through the heat-insulating region between the walls and the elongated structural channel.

29. A low-flexure molten metal distribution launder for distributing molten metal to a plurality of metal casting stations, comprising:

an elongated structural beam which extends longitudinally between opposite ends, the elongated structural beam having an unsupported length for spanning metal casting stations, the elongated structural beam forming an upwardly-open beam channel along the unsupported length, the upwardly-open beam channel having a bottom wall and opposed sidewalls;

a plurality of metal level sensors which extend downward from the unsupported length of the elongated structural beam to measure molten metal levels in metal casting stations;

a plurality of spaced U-shaped refractory hangers received within the upwardly-open beam channel to form a refractory channel along the unsupported length of the elongated structural beam; each refractory hanger having a bottom wall which is spaced from the bottom wall of the upwardly-open beam channel, each refractory hanger having sidewalls which are spaced from the sidewalls of the upwardly-open beam channel; each refractory hanger having a medial portion along its longitudinal length which is securely positioned relative to the elongated structural beam, each refractory hanger having distal portions along its longitudinal length which are free to move longitudinally relative to the elongated structural beam;

a plurality of refractory liners received within the refractory hangers to form a molten metal trough along the unsupported length of the elongated structural beam, wherein each refractory hanger spans at least one refractory hanger, the refractory liners having longitudinal ends which are positioned at central longitudinal positions within the refractory holders; and a plurality of downspouts which extend through the refractory liners from the molten metal trough to deliver molten metal from the molten metal trough into casting stations.

30. A low-flexure molten metal distribution launder as recited in claim 29, further comprising a beam support beneath one of the elongated structural beam's opposite ends, wherein the beam support comprises a roller to allow longitudinal movement of said one of the opposite ends to accommodate expansion and contraction of the elongated structural beam.

31. A low-flexure molten metal distribution launder as recited in claim 29, wherein each refractory hanger has upper support lips extending outward from its sidewalls, the elongated structural beam having longitudinally-extending hanger support surfaces upon which the upper support lips are supported.

32. A low-flexure molten metal distribution launder as recited in claim 29, an air duct being formed longitudinally through the upwardly-open beam channel along the walls of the refractory hangers.

33. A low-flexure molten metal distribution launder as recited in claim 29, an air duct being formed longitudinally through the upwardly-open beam channel along the walls of the refractory hangers, the low-flexure metal distribution launder further comprising an air blower in fluid communication with the air duct to circulate cooling air through the air duct.

34. A low-flexure molten metal distribution launder as recited in claim 29, each downspout comprising:

a spout sleeve extending vertically between the bottom walls of the elongated structural beam and one of the refractory hangers, the spout sleeve being attached to the medial longitudinal portion of said one of the refractory hangers to securely position said medial longitudinal portion of said one of the refractory hangers relative to the elongated structural channel.

35. A low-flexure molten metal distribution launder as recited in claim 29, wherein:

the refractory hangers have first longitudinal lengths and the refractory liners have second longitudinal lengths, the second longitudinal lengths being whole multiples of the first longitudinal lengths;

the low-flexure metal distribution launder further comprises a spout sleeve extending vertically through the heat-insulating region between the elongated structural channel and one of the refractory hangers, the spout sleeve being attached to a medial longitudinal portion of said one of the refractory hangers to securely position said medial longitudinal portion of said one of the refractory hangers relative to the elongated structural channel.

* * * * *